US005361670A

United States Patent [19]

Lombardi

[11] Patent Number: 5,361,670

[45] Date of Patent: Nov. 8, 1994

[54] MULTI-AXLE DRUM BEATER AND PEDAL APPARATUS

[75] Inventor: Donald G. Lombardi, Thousand Oaks, Calif.

[73] Assignee: Drum Workshop, Inc., Oxnard, Calif.

[21] Appl. No.: 35,065

[22] Filed: Mar. 22, 1993

Related U.S. Application Data

[63] Continuation of Ser. No. 783,864, Oct. 28, 1991, Pat. No. 5,204,485.

[51] Int. Cl.[5] ..... G10D 13/00

[52] U.S. Cl. ..... 84/422.1

[58] Field of Search ..... 84/422.1–422.4

[56] References Cited

U.S. PATENT DOCUMENTS

| | | | |
|---|---|---|---|
| 3,618,441 | 11/1971 | Fearns | 84/422 |
| 3,742,806 | 7/1973 | Zalmer | 84/422 |
| 3,968,718 | 7/1976 | Carver | 84/422 R |
| 4,188,853 | 2/1980 | Bills | 84/422 R |
| 4,538,499 | 9/1985 | Livingston | 84/422 R |
| 4,756,224 | 7/1988 | Lombardi | 84/422 R |
| 4,945,803 | 8/1990 | Norwood | 84/422.1 |

FOREIGN PATENT DOCUMENTS

| | | |
|---|---|---|
| 62-201792 | 12/1987 | Japan . |
| 644147 | 2/1989 | Japan . |

*Primary Examiner*—William M. Shoop, Jr.
*Assistant Examiner*—Jeffrey W. Donels
*Attorney, Agent, or Firm*—William W. Haefliger

[57] ABSTRACT

A drum beating assembly comprising a first frame including first pedestal structure; first, second and third bearings carried by the first pedestal structure, in spaced coaxial relation; a primary axle carried by the first and third bearings, and a primary drum beater carried by the primary axle; a secondary axle carried by the second arid third bearings, and a secondary drum beater carried by the secondary axle; the primary and secondary axles being independently rotatable, there being a first pedal operatively connected to the primary axle to rotate the primary axle and primary drum beater in response to pedal pivoting, the secondary axle and secondary drum beater being rotatable by auxiliary structure, adjustably positioned relative to the first frame; and a first base plate integrally supporting the first pedestal structure, the first plate also supporting the first pedal for pivoting relative thereto.

16 Claims, 3 Drawing Sheets

3
22c
21c
22a
21a
22
21
22b
21b
16
16b
16c
56a
61
58a
15
19
18
14
58c
54
42
60
59
58b
19c
49
12a
22d
16a
21d
56
17
11
46
12
35
41
31
13
10
3

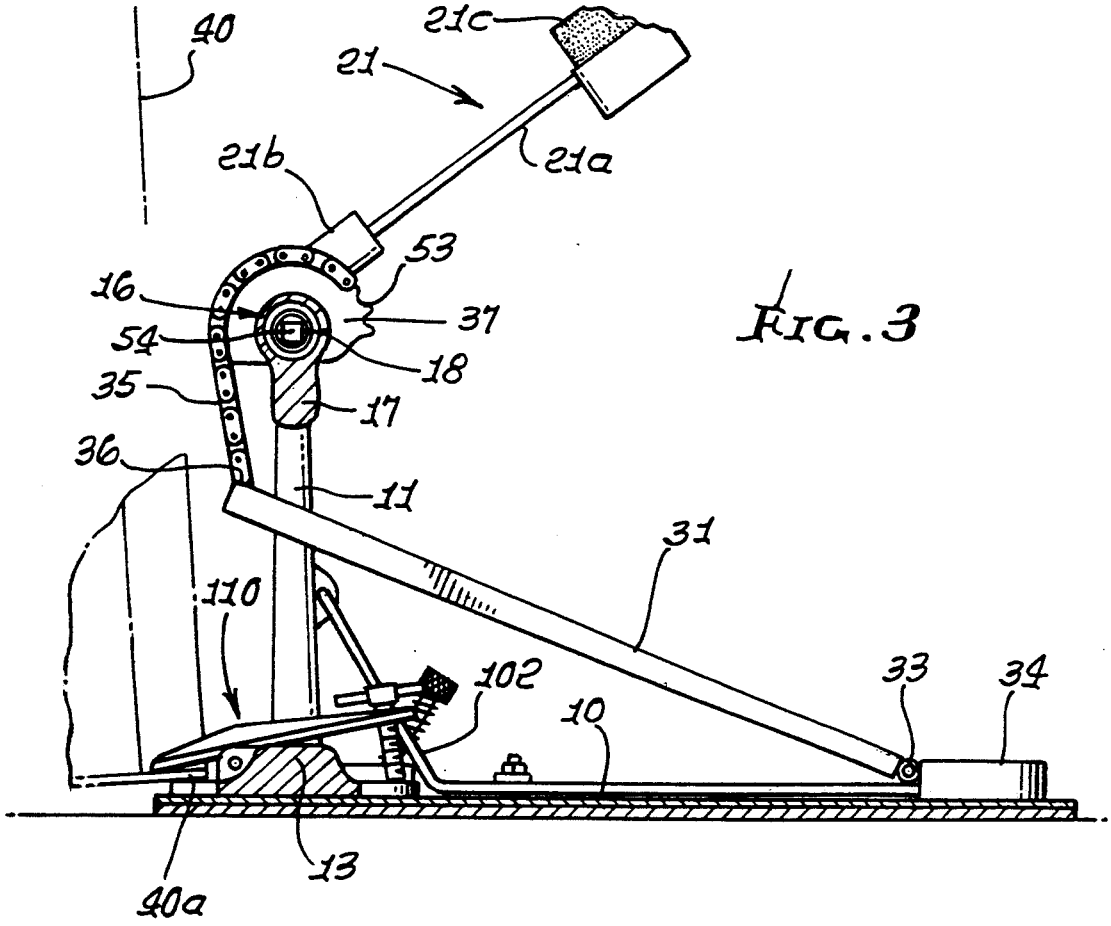
FIG. 3
FIG. 5.
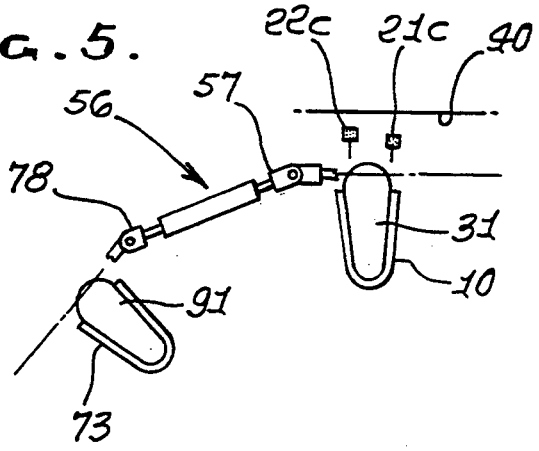

MULTI-AXLE DRUM BEATER AND PEDAL APPARATUS

This is a continuation, of application Ser. No. 783,864, filed Oct. 28, 1991, now U.S. Pat. No. 5,204,485.

BACKGROUND OF THE INVENTION

This invention relates generally to drum beating apparatus having multiple beaters, and more particularly concerns the operation and mounting of such beaters.

There is need for drum beating apparatus in which two beaters are located close to one another to strike the same drum surface, but wherein the two beaters are independently operable by foot pedals located at different, separate positions. No prior apparatus meets this objective in the novel and unusually advantageous ways as now afforded by the present invention incorporating unusually advantageous structural combinations and modes of operation.

SUMMARY OF THE INVENTION

It is a major object of the invention to provided improved drum beating apparatus meeting the above as well as other needs and objectives. Basically, the invention is embodied in a combination that includes:

a) a first frame including first pedestal means, b) first, second and third bearings carried by the first pedestal means, in spaced coaxial relation, c) a primary axle carried by the first and third bearings, and a primary drum beater carried by the primary axle, d) a secondary axle carried by the second and third bearings, and a secondary drum beater carried by the secondary axle, e) the primary and secondary axles being independently rotatable, there being a first pedal operatively connected to the primary axle to rotate the primary axle and primary drum beater in response to pedal pivoting, the secondary axle and secondary drum beater being rotatable by auxiliary means, f) and a first base plate integrally supporting the first pedestal means, the first plate also supporting the first pedal for pivoting relative thereto.

As will appear, the third bearing typically may include two axially spaced bearing elements, there being a housing for those elements, and an arm carried by the first pedestal means and supporting the housing, the primary axle supported by one of the elements, and the secondary axle supported by the other of the elements.

Another object is to provide a primary rotor on the primary axle and a flexible coupling interconnecting the first pedal and primary rotor to rotate the rotor and primary axle when the pedal is pivotally displaced downwardly, and yieldable means operatively connected between the primary axle and first frame to yieldably resist pedal effected rotation of the primary axle.

A further object is to provide an elongated rotary link coupled to the secondary axle, the link consisting of relatively lightweight metal, the link defined by the auxiliary means. In this regard, and as regards such auxiliary means, the invention may provide a second frame including second pedestal means, and a second base plate, independent of the first frame; other bearing means on the second pedestal means; a tertiary axle carried by the other bearing means; the link operatively connecting the secondary and tertiary axles; there being a second pedal operatively connected to the tertiary axle to rotate the third axle, the link, the secondary axle, and the secondary drum beater; the second pedal and tertiary axle also defined by the auxiliary means; and a second base plate integrally supporting the second pedestal means, the second base plate also supporting the second pedal for pivoting relative thereto.

Yet another object is to provide a double drum pedal apparatus in which a first pedal frame is provided with rotatable first and second beaters and a first pedal for rotating the first beater when pushed down; a second pedal frame being provided with a second pedal; the second beater having a supporting shaft operatively connected to the second pedal; and characterized in that the first pedal frame is provided with first, second and third bearing portions, the first beater having a supporting shaft supported by the first and second bearing portions, the shaft supporting the second beater being supported by the second and third bearing portions, whereby the second shaft is rotatable independently of the first shaft.

These and other objects and advantages of the invention, as well as the details of an illustrative embodiment, will be more fully understood from the following specification and drawings, in which:

DRAWING DESCRIPTION

FIG. 3 is a section taken on lines 3—3 of FIG. 2;

FIG. 5 is a diagrammatic view showing relative adjustability of two pedals on two base plates, in association with two drum beaters which have fixed relative positions.

DETAILED DESCRIPTION

Figure 1:
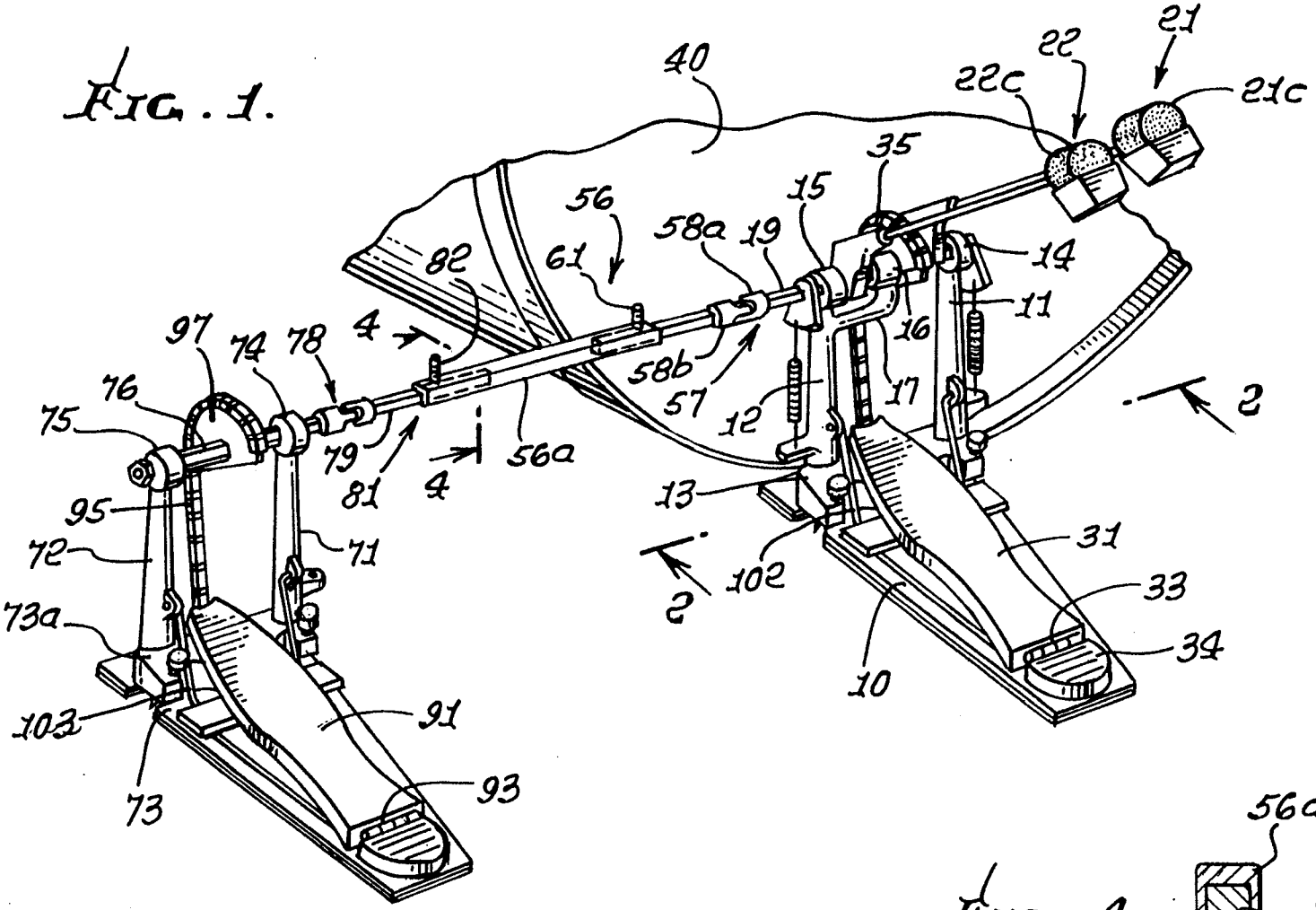
FIG. 1 is a perspective view of the apparatus incorporating the invention.
Figure 4:
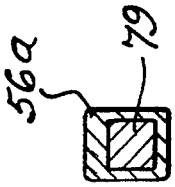
FIG. 4 is a section taken on lines 4—4 of FIG. 1.

In the drawings, a first horizontal, longitudinally extending base plate 10 integrally supports a first frame that includes first pedestal means. Such pedestal means is shown to include laterally spaced, upright pedestals 11 and 12, the lower ends of which are carried by a bottom yoke 13 attached to a base plate forward portion. The upper ends of the pedestals carry first and second coaxial bearing sleeves 14 and 15, which are laterally spaced apart. The pedestal means also carries third bearing structure 16, and specifically, an arm 17 extends laterally rightwardly from pedestal 12, and upwardly, to support structure 16. The latter includes a bearing housing **16*a*, and two roller bearing parts 16*b* and 16*c* positioned in housing 16*a*, in laterally spaced relation. Arm 17 is elbow-shaped and is integral with 12 and 16*a*. A primary axle or shaft 18 is carried by the first and third bearings, and specifically, by bearing sleeve 14 and bearing part 16*b*; and a secondary axle or shaft 19 is carried by the second and third bearings, and specifically, by the bearing sleeve 15 and bearing part 16*c*, the axles 18 and 19** being independently rotatable, yet coaxial.

A primary drum beater 21 is carried by the primary axle 18, and a secondary drum beater 22 is carried by the secondary axle 19, whereby the two beaters are separately operable. Note that the beater 21 has a shaft **21*a* and a connector 21*b* to axle 18; and beater 22 has a shaft 22*a* and a connector 22*b* to axle 19, both connectors laterally spaced, and located between the bearing sleeves 14 and 15 on the pedestals. See also the beater heads 21***c* and 22*c*. Axles 18 and 19 are polygonal to rigidly connect to the elements 21*b* and 22*b*.

A first pedal 31 is operatively connected to the primary axle 18 to rotate that axle and the primary beater 21 in response to pedal pivoting effected by the foot of the drummer.

In the FIG. 3 example, the pedal is pivoted at 33 to a heel support 34 attached to plate 10. A flexible coupling, such as chain 35, is connected at 36 to the forward end of the pedal, and extends upwardly to mesh with and wrap on sprocket 37. The latter is fixedly mounted on axle 18, whereby, as the pedal is pushed down, the sprocket and axle 18 are rotated, and the beater 21 rotates forwardly, so that head 21*c* strikes the drum surface indicated at 40. Yieldable means, such as tension spring 41 is operatively connected between the primary axle and the frame, such as the lower end of pedestal 11, to yieldably resist axle rotation, and return the beater to FIG. 3 position. Note that spring 41 has its upper end connected to crank 42 on shaft or axle 18.

A similar spring 46 is operatively connected between secondary axle 19 and the frame, such as the lower end of pedestal 12, to yieldably resist axle 19 rotation, to return secondary drum beater 22 to retracted position, as indicated in FIG. 3. That spring has its upper end connected to a crank 49 on shaft 19.

Axles 18 and 19 may have square cross sections to enable positive connection of the sleeve-type connectors 21*c* and 22*c* to the axles, set screws 21*d* and 22*d* also being provided. Annular bearings receive the axles for reception in the bearing sleeves 14 and 15.

The surface portions, including teeth 53 on the sprocket 37, may be located at progressively increasing radii from an axis 54 defined by axle 18, and located angularly about that axis, whereby those surface portions extend eccentrically relative to axis 54, as disclosed in U.S. Pat. No. 4,756,224. This causes the beater to travel progressively faster toward the drum surface, as the pedal is displaced downwardly at a fixed angular velocity.

The secondary axle 19 and secondary drum beater 22 may be rotatable by auxiliary means not mounted on plate 10. Such secondary means may, for example, include an elongated and elongatable rotary link 56 coupled to axle 19, as by coupling structure 57. The latter is shown to include universal joint members 58*a* and 58*b* rotatably interconnected by cross pin 58*c*. Member 58*a* is connected to the end 19*c* of axle 19 projecting away from the bearing 15; and member 58*b* is connected to a square cross section sub-shaft 59, as by transverse pin 60. Shaft 59 is also received in and connected to link member 56*a* via a coupling set screw 61, allowing extension of 56*a* and 59.

Figure 2:
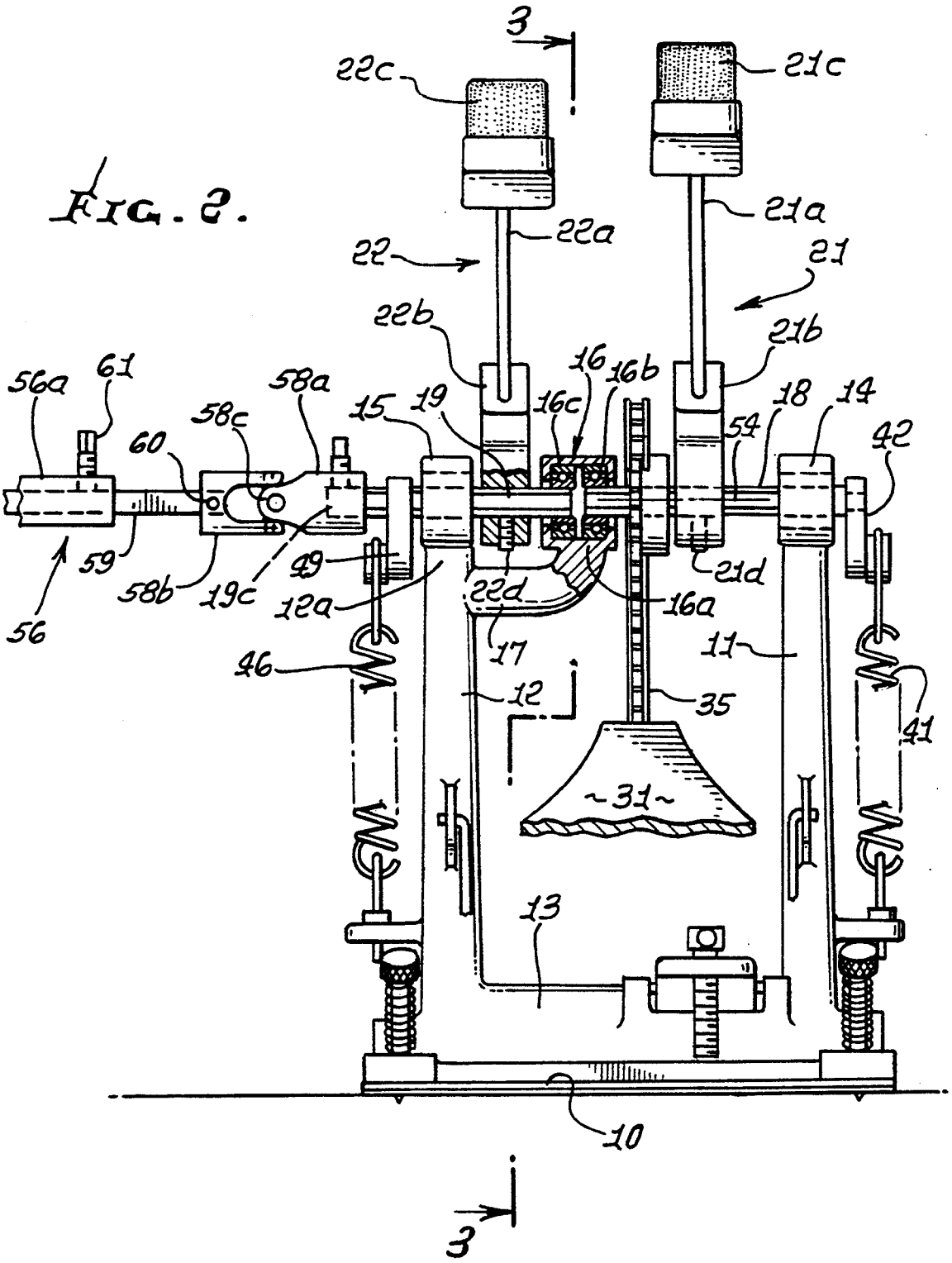
FIG. 2 is an enlarged section taken in elevation on lines 2—2 of FIG. 1.

Note that bearing 15 is coaxial with bearing 16, and carried by upper extension 12*a* of the pedestal. That upper extension 12*a* and arm 17 form a yoke, and between which beater 22 connector 22*b* is located. The two bearings 16*b* and 16*c* being separate may allow for some degree of axial mis-alignment of the axles 18 and 19, whereby each axle 18 and 19 is freely supported for rotation by only two bearings, yet the two beaters are located in close lateral relation, as seen in FIG. 2. Arm 17 is located above the pedal 31 so as not to interfere with it.

FIG. 1 shows the provision of a second frame, including second pedestal means, such as upright pedestals 71 and 72. The latter are integrally mounted via bottom yoke 73*a* on a second base plate 73 which is independent of plate 10 and can be adjustably positioned at different locations relative to plate 10, to suit the drummer. See FIG. 5. Other bearing means, such as bearing sleeves 74 and 75, are carried by the second pedestals 71 and 72, and a tertiary axle or shaft 76 extends laterally and is carried for rotation by the sleeves 74 and 75. Link 56 is connected to axle 76 as by structure 71 corresponding to structure 57. See for example universal joint 78, square cross section sub-shaft 79, and elongatable coupling 81. Set screws 82 and 61 are associated with the couplings 61 and 56 to adjustably grip the sub-shafts, allow complete disassembly or disconnection of the two axles 19 and 76, and the two base plates 10 and 73. Elongated link member 56*a* advantageously consists of lightweight metal, such as aluminum.

A pedal 91 is pivotally mounted at 92 on second base plate 73, and a flexible coupling, such as a chain 95, couples the forward end of the pedal 91 to a sprocket 97 attached to axle 76. Accordingly, the pedal 91 is coupled to the second beater 22 to rotate same, as pedal 91 is pushed downwardly. Plate or sprocket 97 may be eccentric, as described above, as respects sprocket 37. Holder members 102 and 103 also support the pedestals on the base plates, as shown.

Accordingly, the invention provides a first pedal frame with rotatable first and second beaters and a first pedal for rotating the first beater when pushed down; a second pedal frame being provided with a second pedal; the second beater having a supporting shaft operatively connected to the second pedal; and characterized in that the finest pedal frame is provided with first, second and third bearing portions, the first beater having a supporting shaft supported by the first and second bearing portions, the shaft supporting the second beater being supported by the second and third bearing portions, whereby the second shaft is rotatable independently of the first shaft.

Adjustable clamp means 110 on the forward end of the plate 10 clamps to drum structure 40*a*, as shown.

I claim:

1. In a drum beating assembly, the combination comprising a) a first frame including first pedestal means, b) first, second and third bearing structures carried by the first pedestal means, in spaced coaxial relation, said third bearing structure including two axially spaced bearing elements, and housing structure for said third bearing structure, c) a primary axle carried by the first and third bearing structure, and a primary drum beater carried by the said primary axle, d) a secondary axle carried by the second and third bearing structures, and a secondary drum beater carried by said secondary axle, e) said primary and secondary axles being independently rotatable, there being a first pedal operatively connected to the primary axle to rotate the primary axle and primary drum beater in response to pedal pivoting, the secondary axle and secondary drum beater being rotatable by auxiliary means, adjustably positioned relative to the first frame, f) and a first base plate integrally supporting said first pedestal means, the first plate also supporting the first pedal for pivoting relative thereto, g) said first pedestal means including primary and secondary upright pedestals respectively carrying said first and second bearing structures, said housing structure for said third bearing structure being located between and spaced from said first and second bearing structures, there being an arm having one end connected to the secondary upright pedestal below the second bearing structure, the arm extending sidewardly from said secondary pedestal above the level of said pedal and then upwardly to that housing structure which is mounted on said arm, h) the primary axle extending to and supported by said first bearing structure, and one of said two axially spaced bearing elements, and the secondary axle supported by the second bearing structure, and the other of said two axially spaced bearing elements.

2. The combination of claim 1 including a primary rotor on the primary axle and a flexible coupling interconnecting the first pedal and primary rotor to rotate the rotor and primary axle when the pedal is pivotally displaced downwardly, and yieldable means operatively connected between the primary axle and first frame to yieldably resist pedal effected rotation of the primary axle, and also connected between the secondary axle and first frame to yieldably resist rotation of the secondary axle by said auxiliary means.

3. The combination of claim 2 wherein the primary rotor has surface portions engaged by said coupling means, said surface portions located at progressively increasing radii from an axis defined by said primary axle, and angularly about said axis.

4. The combination of claim 3 wherein said surface portions extend eccentrically relative to said axis.

5. The combination of claim 4 wherein said axles extend in coaxial relation.

6. The combination of claim 1 including an elongated rotary link coupled to said secondary axle, said link consisting of relatively lightweight metal, said link defined by said auxiliary means.

7. The combination of claim 6 comprising a second frame, including second pedestal means, and a second base plate, independent of said first frame; other bearing means on said second pedestal means; a tertiary axle carried by said other bearing means; said link operatively connecting said secondary and tertiary axles; there being a second pedal operatively connected to the tertiary axle to rotate the tertiary axle, said link, said secondary axle, and said secondary drum beater; said second pedal and tertiary axle also defined by said auxiliary means.

8. The combination of claim 1 including an elongated link coupled to said secondary shaft; a second frame including second pedestal means; other bearing means on said second pedestal means; a tertiary axle carried by said other bearing means; said link operatively connecting said secondary and tertiary axles; there being a second pedal operatively connected to the tertiary axle to rotate the third axle, said link, said secondary axle, and said secondary drum beater; said second pedal tertiary axle and link defined by said auxiliary means; and a second base plate integrally supporting said second pedestal means, the second base plate also supporting the second pedal for pivoting relative thereto.

9. The combination of claim 8 including a primary rotor on the primary axle and a flexible coupling interconnecting the first pedal and primary rotor to rotate the primary rotor and primary axle when the first pedal is pivotally displaced downwardly; and yieldable means operatively connected between the primary axle and first frame to yieldably resist first pedal effected rotation of the primary axle.

10. The combination of claim 9 including another rotor on the tertiary axle, and a flexible coupling interconnecting the other rotor and said second pedal.

11. The combination of claim 10 wherein said rotors have coupling engageable surfaces which are each eccentric relative to said primary and tertiary axles, respectively.

12. A double drum pedal apparatus in which a first pedal frame is provided with rotatable first and second beaters, and a first pedal for rotating said first beater when pushed down; a second pedal frame being provided with a second pedal; said second beater having a supporting second shaft operatively connected to said second pedal; and characterized in that said first pedal frame is provide with first, second and third bearing structures, the first beater having a supporting first shaft supported by said first and third bearing structures, said second shaft supporting the second beater being supported by said second and third bearing structures, whereby the second shaft is rotatable independently of the first shaft, said first pedal frame including primary and secondary upright pedestals, said first bearing structure mounted on the primary pedestal, said second bearing structure mounted on said secondary pedestal, said first pedal frame including an arm connected to the secondary pedestal and extending sidewardly therefrom above the level of the first pedal, said third bearing structure mounted by said arm and said secondary pedestal, said third bearing structure including two coaxial bearing elements respectively supportively associated with said first and second shafts.

13. In a drum beating assembly, the combination comprising a) a first frame including first pedestal means, b) first, second and third bearings carried by the first pedestal means, in spaced coaxial relation, said third bearing including at least one bearing element, and a housing for said third bearing, c) a primary axle carried by the first and third bearings, and a primary drum beater carried by the said primary axle, d) a secondary axle carried by the second bearing, and a secondary drum beater carried by said secondary axle, e) said primary and secondary axles being independently rotatable, there being a first pedal operatively connected to the primary axle to rotate the primary axle and primary drum beater in response to pedal pivoting, the secondary axle and secondary drum beater being rotatable by auxiliary means, adjustably positioned relative to the first frame, f) and a first base plate integrally supporting said first pedestal means, the first plate also supporting the first pedal for pivoting relative thereto, g) said first pedestal means including primary and secondary upright pedestals respectively carrying said first and second bearings, said housing for said third bearing being located between and spaced from said first and second bearings, there being an arm having one end connected to the secondary upright pedestal below the second bearing, the arm extending sidewardly from said secondary pedestal above the level of said pedal and then upwardly to that part of said housing closest to said first bearing, h) the primary axle extending to and supported by said first bearing and said one bearing element, and the secondary axle supported by the second bearing.

14. The combination of claim 13 wherein said housing part closest to said first bearing is in a space formed between said primary and secondary upright pedestals.

15. The combination of claim 13 wherein said axles extend in coaxial relation.

16. The combination of claim 13 wherein said second and third bearings provide multiple axially spaced bearing sections supported by the secondary upright pedestal.

* * * * *